US006557442B1

(12) United States Patent
Owoc

(10) Patent No.: US 6,557,442 B1
(45) Date of Patent: May 6, 2003

(54) ADJUSTABLE WRENCH

(76) Inventor: Greg J. Owoc, 106 Galphin Dr., Greenville, SC (US) 29603

( * ) Notice: Subject to any disclaimer, the term of this patent is extended or adjusted under 35 U.S.C. 154(b) by 0 days.

(21) Appl. No.: 10/024,673

(22) Filed: Dec. 17, 2001

Related U.S. Application Data

(63) Continuation-in-part of application No. 09/333,017, filed on Jun. 15, 1999, now Pat. No. 6,382,058.

(51) Int. Cl.[7] ..... B25B 23/16
(52) U.S. Cl. ..... 81/177.9; 81/177.8
(58) Field of Search ..... 81/177.7, 177.8, 81/177.9, 177.85, 177.2

(56) References Cited

U.S. PATENT DOCUMENTS 1,205,149 A * 11/1916 Bovee ..... 81/177.9
2,978,938 A * 4/1961 Nalley ..... 81/177.8
5,768,960 A * 6/1998 Archuleta ..... 81/177.8
5,862,723 A * 1/1999 Rowlands ..... 81/177.9
6,000,302 A * 12/1999 Chiang ..... 81/177.9
6,167,787 B1 * 1/2001 Jarvis ..... 81/177.8
6,220,125 B1 * 4/2001 Lan ..... 81/177.9

* cited by examiner

*Primary Examiner*—Joseph J. Hail, III
*Assistant Examiner*—Hadi Shakeri
(74) *Attorney, Agent, or Firm*—McNair Law Firm, P.A.

(57) ABSTRACT

A wrench comprising a wrench head with a stud at one end, a handle, including a handle end with a second stud at one end and an intermediate handle having yokes at opposed ends. A first yoke is pivotally engaged with the wrench head stud and a second yoke is pivotally engaged with the handle end stud. A plurality of paired detent surfaces are arranged over end portions of the yokes and cooperates with a detent ring carried by the handle end. The intermediate handle includes a longitudinal bore and a transverse bore which passes through the longitudinal bore. A positioning member, movable between a locking position and a non-locking position, is carried in the transverse bore. An engaging member, movable between an engaged position and a disengaged position, is carried in the longitudinal bore. The positioning member is positionable to positively lock the engaging member with an associated stud and to allow the engaging member to become disengaged from the stud.

15 Claims, 4 Drawing Sheets

A
B
C
D
E
10
11
12
14
14'
16
18
20
20'
22
24
24'
30
32
32'
34
36
36'
38
38'
40
41
42
42'
46
46'
48
50
52
52'
54

ADJUSTABLE WRENCH

This is a continuation-in-part of application Ser. No. 09/333,017, now U.S. Pat. No. 6,382,058 filed Jun. 15, 1999.

BACKGROUND OF THE INVENTION

This invention is directed to a wrench with a handle capable of assuming multiple work positions.

The concept of this type wrench structure is not new, however, the known structures do not include positive locking components or do not include multiple adjustment areas along the handle length as illustrated by U.S. Pat. Nos. 2,028,561 and 3,270,597.

The instant invention has as a primary object a wrench with a handle with a plurality of segments each adjustable into a plurality of positions.

Another object of the invention is a wrench in which each handle segment is independently adjustable relative to an adjacent segment.

Another object of the invention is an adjustable wrench handle having a plurality of locking members at some of its adjustable joints.

Another object of the invention is a wrench handle having a plurality of adjustable positions and a positive locking member positively locking handle segments into selective relative positions.

SUMMARY OF THE INVENTION

The invention is directed to a wrench, including a head having a handle capable of assuming multiple work positions and a positive locking member positively locking adjacent handle segments in selected positions. The handle includes a handle end having a stud at one end and an intermediate handle having a yoke at each end. A first of the yokes is pivotally engaged with a stud formed with the head and the second yoke is pivotally engaged with the handle end stud. Each of the studs includes spaced teeth about a portion of its periphery.

A longitudinally movable detent ring is positioned over an end of the handle end. The detent ring is resiliently urged into engagement with paired detent surfaces arranged over end portions of the adjacent yoke. The combination forms a ring engaging assembly.

A longitudinal bore with a transverse bore passing there through is formed in the intermediate handle member. A positioning member which is movable between a locking position and a non-locking position is carried in the transverse bore. An engaging member which is movable between an engaged position and a disengaged position is carried in the longitudinal bore. When the positioning member is positioned in the locking position it acts to positively lock the engaging member in the engaged position. The engaging member when in the engaged position is inter engaged with teeth formed in each of the studs.

A receiving area is associated with the longitudinal bore for receiving a spring. The spring acts to urge the engaging member outwardly along the longitudinal bore and into engagement with teeth of at least one of the studs. The receiving area is an enlarged area adjacent an end of the longitudinal bore.

The engaging member generally includes an engaging head and an engaging shaft independent of the engaging head with the receiving area being located between opposing ends of the engaging head. The engaging shaft acts to urge the engaging head outwardly. The engaging member may include an engaging head connected with an engaging shaft with the spring engaging with the engaging head within said longitudinal bore. The engaging member may include a ball. The face of the engaging head may have transverse teeth adapted to engage with the teeth of the associated of the studs. There may be a front and a rear engaging member with the front engaging member being associated with the wrench head stud and the rear engaging member being associated with the handle and stud.

A positioning member may be carried in the transverse bore in engagement with the engaging member. The positioning member is movable between a non-locking position in which it allows the engaging member movement along the longitudinal bore and a locking position in which the engaging member is locked in engagement with the positioning member. Normally a spring urges the positioning member into the lock position.

The engaging member may include first and second engaging heads carried adjacent respective ends of the intermediate handle portion. The first and second engaging heads are movable longitudinally of the intermediate handle portion.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figures 1, 2:
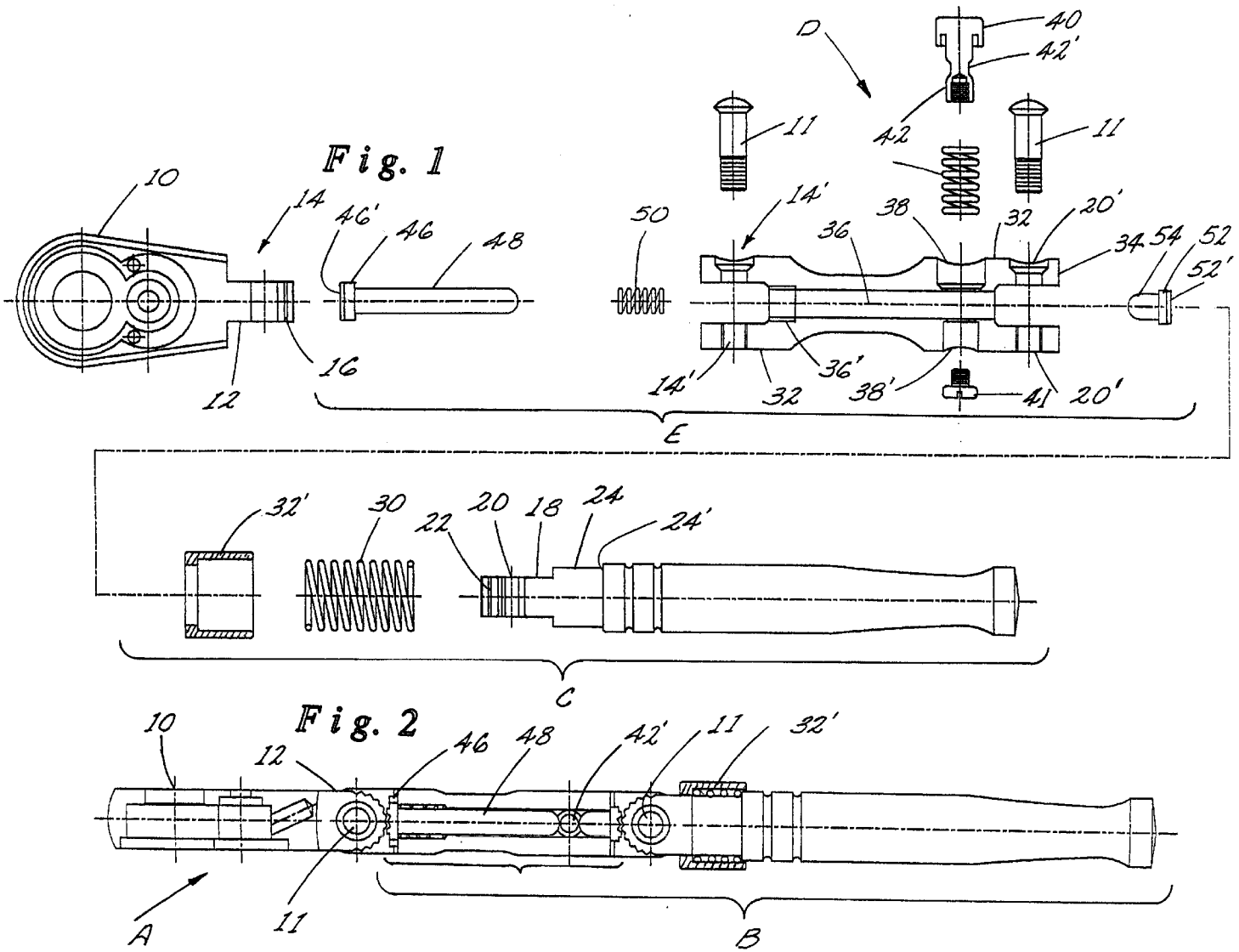
FIG. 1 is a top part sectional view of the wrench of the invention with the parts separated.
FIG. 2 is a side part sectional view of the wrench of FIG. 1.

FIGS. 1 and 2 show a first arrangement of the wrench of the invention. Wrench A includes a usual head portion 10 which preferably is a ratchet head but could be any type of standard wrench head. Head 10 includes stud 12 at one end. Stud 12, which projects from one side of the head, includes an axial bore 14 through a half circular end projection. Teeth 16 are arranged about the outer surface of stud 14.

Adjustable handle B is connected with head 10 with bolt 11 through bores 14', 14 and includes an intermediate handle D and a handle end C.

Handle end C includes a stud 18 extending from one end. Stud 18 is similar to stud 12 and includes bores 20, 21' and teeth 22 about its outer surface. Adjacent the end of handle end C is a reduced diameter portion 24 and a raised shoulder 26. A coiled spring 30 is carried over portion 24 and retained in position by shoulder 26. Detent ring 32' fits over spring 30 and is urged toward stud 18.

Intermediate handle D carries a yoke 32 at each end. The outer surfaces of each yoke are formed with a plurality of paired detent members 34. A longitudinal bore 36 passes completely through intermediate handle D along its longitudinal axis. Transverse bore 38 passes perpendicularly through the intermediate handle and through the transverse axis of bore 36.

Positioning member 40 along with spring 44 are positioned in bore 38. Positioning member 40 engages with screw 41 in bore 38'. Bore 38' allows movement of shaft 42 but is smaller than screw 41 which acts to retain the positioning member in the bore. Spring 44 urges it outwardly in the direction of the arrow.

Positioning member 40 includes a shaft 42 with an enlarged diameter area and a reduced diameter area 42'.

In its locking position positioning member 40 is urged away from the longitudinal axis of bore 36 by spring 44 until enlarged area of shaft 42 is aligned with the axis of bore 36. In its unlocking position, positioning member is depressed into bore 38 until smaller diameter portion 42' is aligned with the axis of bore 36. Normally spring 44 maintains positioning member 40 in the locking position.

An engaging member E is carried by intermediate handle D in bore 36. The engaging member comprises an engaging head 46 with teeth 46' which act to engage with teeth 16 of stud 12. Spring 50 engages over shaft 48 and is seated in enlarged area 36' of bore 36. Spring 50 acts to urge engaging head 46 outwardly toward stud 12. Engaging member E further includes engaging head 52 which includes teeth 52' and shaft 54. Shaft 54 resides in bore 36 with engaging head 52 positioned adjacent teeth 22 of stud 18. Engaging head 52 is not spring urged.

Shafts 48 and 54 are of a length that when fully positioned in bore 36 their inner ends extend beyond the outer circumference of bore 38'. When positioning member 40 is in its locking position the opposed ends of shafts 48, 54 are engaged with the enlarged area of shaft 42 which locks engaging heads 46, 52 in an outward position with teeth 46', 52' engaged with teeth 16, 20 of studs 12, 18.

When positioning member 40 is depressed reduced diameter area 42' is aligned with bore 36 allowing shafts 48, 54 inward movement, releasing the locking action between teeth 16, 22, 46' and 52'.

It is noted that spring 50 maintains teeth 46' in resilient engagement with stud 12 at all times. This allows teeth 16 to maintain the engaged relationship which is now a resilient locking action between head 10 and intermediate handle D when positioning member 40 is depressed into the non-locking position. Pressure by hand movement releases or disengages the engagement between the teeth allowing the relative position between the intermediate shaft and the head to be adjusted.

The relationship between handle end C and intermediate handle D is similar. A resilient positioning is maintained through spring 30 continuously urging detent ring 32' into contact with detent surfaces 34. Engaging head 52 and shaft 54 are not under resilient pressure so that when reduced area 42' is aligned with bore 36 shaft 54 may move freely allowing engaging head 52 to disengage from teeth 22 of stud 18.

When assembled head 10 is pivotally connected with intermediate handle D by bolt 11 through bores 14, 14' and handle end C is pivotally connected with intermediate handle D through bores 20, 20' as best seen in FIG. 2. The head and handle end are resiliently held in selected relative position when positioning member 40 is depressed into the unlocking position due to the action of springs 30 and 50 against engaging head 46 and detent ring 32'. The action of the detent ring is more fully described in co-pending application Ser. No. 09/333,017. These resiliently held positions may be manually relocated with hand movement.

In the locking position head 10 and handle end C are positively locked in fixed relative positions with intermediate handle D as heads 46 and 52 are held in fixed position by the enlarged portion of shaft 42.

Figure 3:
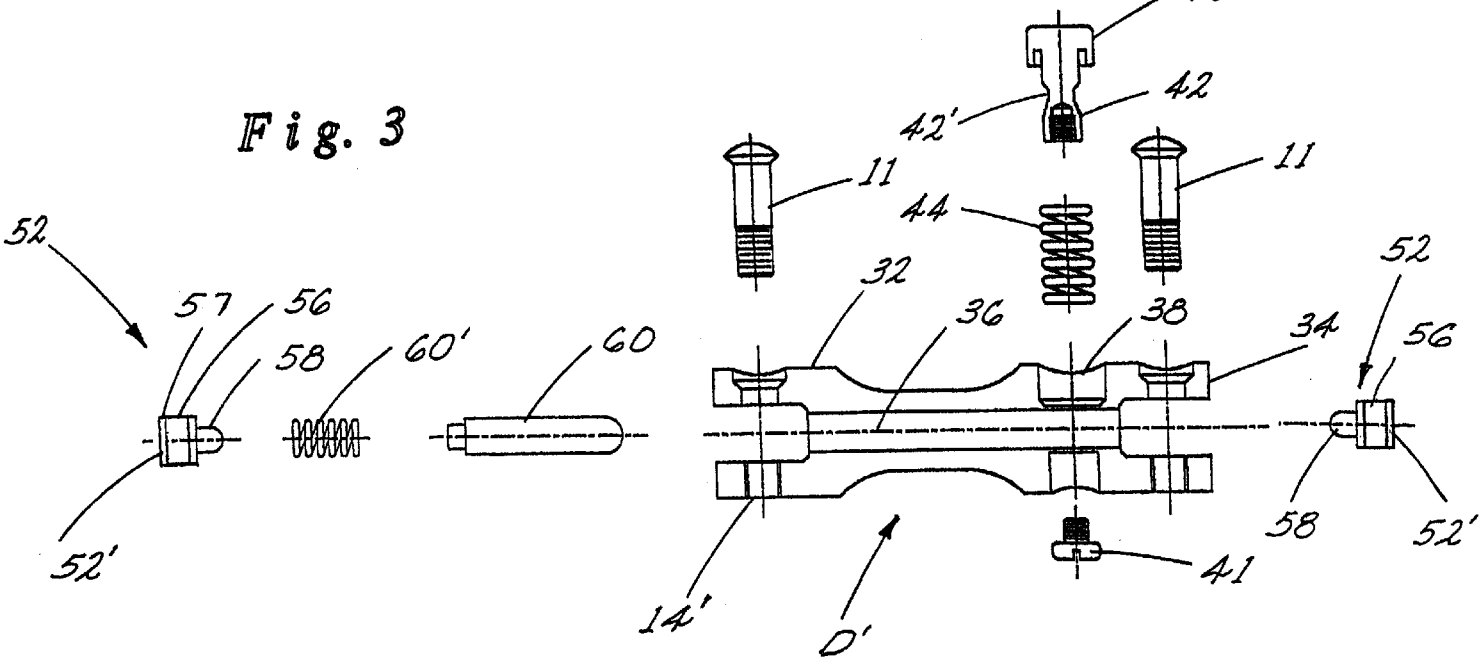
FIG. 3 is an exploded sectional top view of a second arrangement of the intermediate handle portion.
Figure 4:
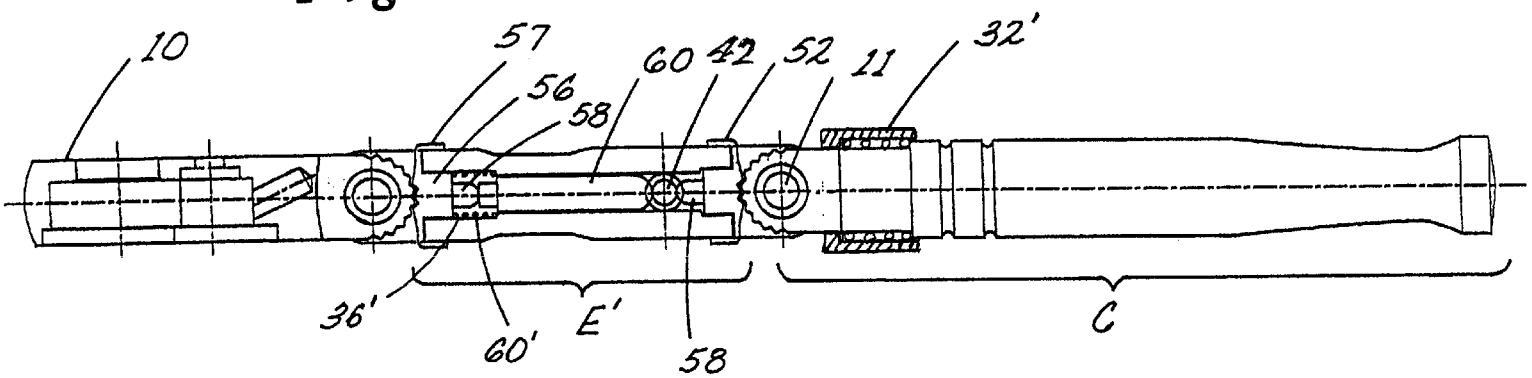
FIG. 4 is a side part sectional view of the invention incorporating the intermediate handle portion of FIG. 3.

Turning now to FIGS. 3 and 4, an alternative arrangement of the wrench of the invention is shown. Like parts are like numbered. In this arrangement head 10 and handle end C are unchanged.

In FIG. 3, intermediate handle $D^1$ includes longitudinal bore 36 and perpendicular bore 38 and positioning member 40.

Engaging member $E^1$ includes a pair of engaging members 52 which include a head 56 which carries on one end a cap 54 and teeth 52'. A short extension 58 extends from the rear side of head 56. Also included is shaft 60 which carries spring 60'.

Assembled, shaft 60 is located in bore 36 between positioning member 40 and spring 60'. An engaging member 52 is positioned over the forward end of intermediate handle $D^1$ with head 56 and extension 58 located in bore 36. Spring 60' is housed in enlarged area 60' between opposed ends of shaft 60 and extension 58. Cap 54 engages over end portions of the intermediate handle between the arms of yoke 32. Cap 54 acts to maintain teeth 52' in proper alignment with teeth 16.

A second engaging head 52 is positioned in the opposite end of bore 36 with extensions 58 adjacent positioning member 40.

The adjustable handle is shown assembled in FIG. 4. The arrangement operates as earlier described.

Figure 5:
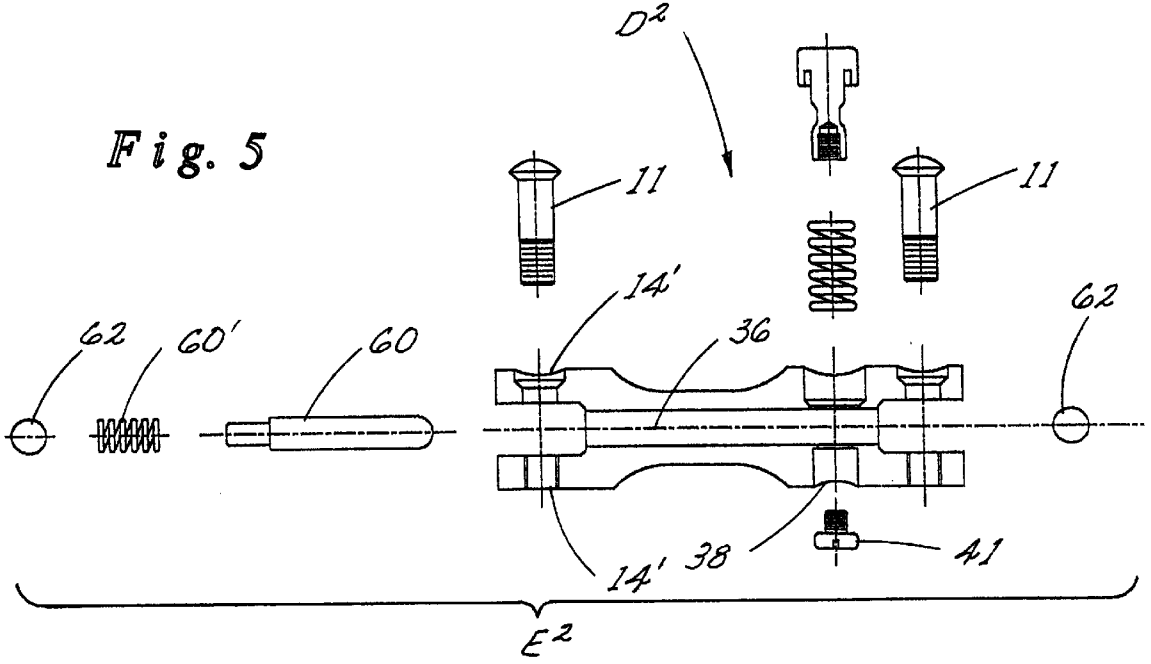
FIG. 5 is an exploded sectional top view of a third arrangement of the intermediate handle portion.
Figure 6:
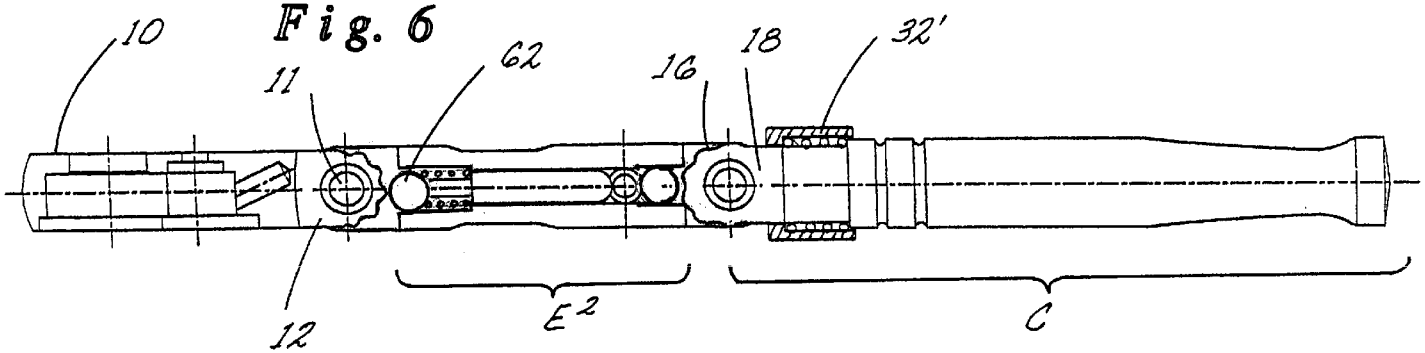
FIG. 6 is a part sectional side view of the wrench incorporating the intermediate handle portion of FIG. 5.

Another arrangement is shown in FIGS. 5 and 6. The intermediate handle $D^2$ is substantially as in FIGS. 5 and 6. In this arrangement, the engaging head comprises ball 62. FIG. 6 shows the arrangement assembled.

Figure 7:
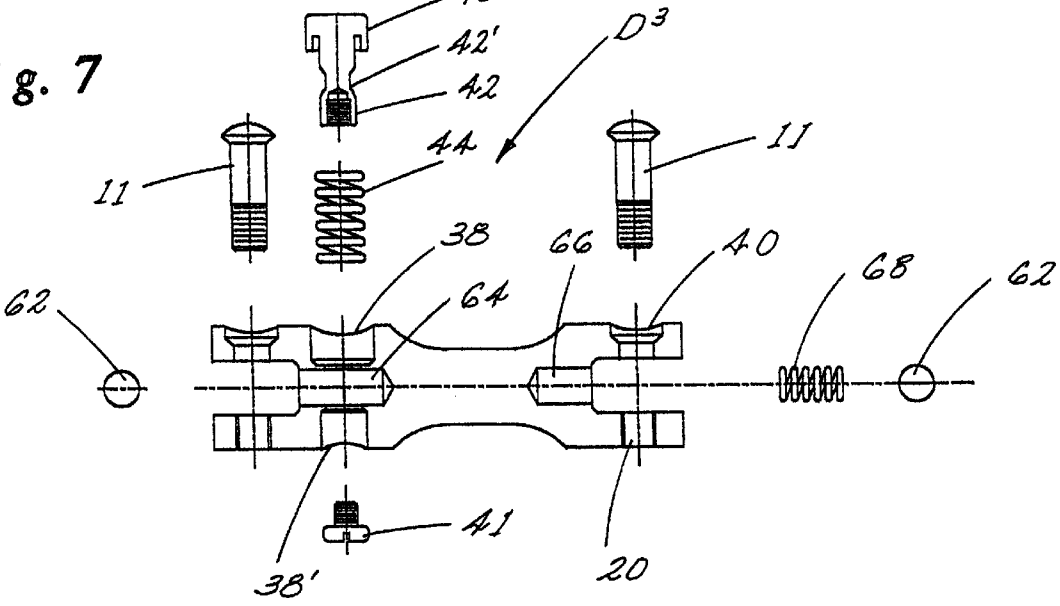
FIG. 7 is an exploded sectional view of a fourth arrangement of the intermediate handle portion.
Figure 8:
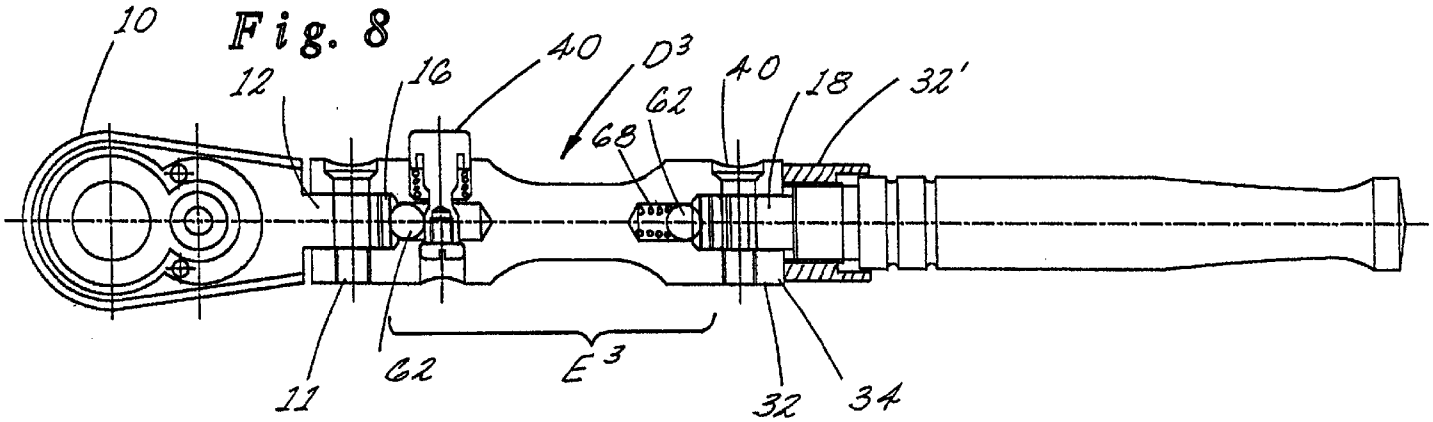
FIG. 8 is a top part sectional view of the wrench incorporating the intermediate handle portion of FIG. 7.

Another arrangement is shown in FIGS. 7 and 8. In FIG. 7 intermediate handle $D^3$ is again formed with transverse bore 38 which passes through longitudinal bore 64. Bore 64 extends only partially through handle $D^3$. A receiving bore 66 is formed in the opposite end of the intermediate handle terminating short of bore 64.

A spring 68 and ball 62 are received in receiving bore 66 as best shown in FIG. 8. The ball is continuously urged outward and into releasable engagement with the toothed surface of stud 18. Handle end C also carries ring 32 which releasably engages with detent surfaces 34 of yokes 32 forming dual releasable locking members for retaining the handle end and intermediate handle in selected positions.

Transverse bore 38 carries positioning member 40 and spring 44. Screw 41 retains positioning member 40 in an outward position with enlarged end 42 located in longitudinal bore 64. End 42 positively maintains engaging ball or engaging member 62 in fixed position in one of teeth 16 of stud 12 maintaining wrench head 12 in locked position relative to the intermediate handle.

To reposition the wrench head positioning member 42 is depressed locating reduced area 42' in alignment with longitudinal shaft 64 and allowing ball 62 to move away from stud 12. The relative position between the wrench head and the handle can now be changed.

While preferred embodiments of the invention have been described using specific terms, such description is for illustrative purposes only, and it is to be understood that changes and variations may be made without departing from the spirit or scope of the following claims.

What is claimed is:

1. A wrench having a handle capable of assuming multiple work positions comprising:

a wrench head having a first stud at one end;

a handle, said handle including a handle end having a second stud at one end and an intermediate handle having first and second yokes at respective ends thereof, said first yoke pivotally engaging with said first stud and said second yoke pivotally engaging with said second stud; said first and second studs including spaced teeth about an outer surface;

said intermediate handle having a longitudinal bore and a transverse bore passing through said longitudinal bore;

a positioning member, carried in said transverse bore; and being movable longitudinally of said transverse bore between a locking position and a non-locking position;

an engaging member carried in said longitudinal bore, said engaging member being movable longitudinally of said longitudinal bore between an engaged position and a disengaged position with said teeth of at least one of said first and second studs;

said positioning member, when positioned in said locking position, positively locks said engaging member in said engaged position.

2. The wrench of claim 1 wherein said longitudinal bore includes a receiving area for receiving a spring, said spring urging said engaging member outwardly along said longitudinal bore into engagement with a stud of said first and second studs.

3. The wrench of claim 2 wherein said receiving area is an enlarged area adjacent an end of said longitudinal bore.

4. The wrench of claim 2 wherein said engaging member includes an engaging head and an engaging shaft independent of said engaging head, said receiving area being located between opposing ends of said engaging head and said engaging shaft urging said engaging head outwardly.

5. The wrench of claim 2 wherein said engaging member includes an engaging head connected with an engaging shaft, said spring engaging with said engaging head within said longitudinal bore.

6. The wrench of claim 2 wherein said engaging member includes a ball.

7. The wrench of claim 3 wherein said engaging head includes a ball.

8. The wrench of claim 3 wherein said engaging member includes a face with transverse teeth adapted to engage with said teeth of an associate of said studs.

9. The wrench of claim 1 wherein said engaging member includes a front and a rear engaging member, said front engaging member being associated with said first stud and said rear engaging member being associated with said second stud.

10. The wrench of claim 9 including a resilient member urging at least one of said front and rear engaging members outwardly along said longitudinal bore.

11. The wrench of claim 1 wherein said positioning member engages with said engaging member in said longitudinal bore, said positioning member being movable between a non-locking position in which said engaging member is allowed inward movement along said longitudinal bore and a locking position in which an end portion of said engaging member is engaged with said positioning member moving said engaging member outward along said longitudinal axis into a fixed locked position.

12. The wrench of claim 11 including a spring engaged with and urging said positioning member into said locking position.

13. The wrench of claim 11 wherein said positioning member comprises an elongate shaft one end of which extends outwardly of an outer surface of said intermediate handle when said positioning member is in said locking position, said elongated shaft having an area of reduced diameter which aligns with said longitudinal bore when said one end is moved into alignment with said outer surface, locating said positioning member in said non-locking position.

14. The wrench of claim 1 wherein said engaging member includes first and second engaging heads carried adjacent said respective ends of said intermediate handle portion, said first and second engaging heads being movable longitudinally of said intermediate handle portion.

15. The wrench of claim 1 including:

a plurality of paired detent surfaces arranged over end portions of at least said second yoke; and a longitudinally and rotably movable detent ring positioned over said one end of said handle end, said detent ring being resiliently urged into engagement with one of said paired detent surfaces of said second yoke forming a ring engaging assembly.

* * * * *